US007341051B2

(12) United States Patent
Batchvarov

(10) Patent No.: US 7,341,051 B2
(45) Date of Patent: Mar. 11, 2008

(54) ELECTRONIC HIGH FREQUENCY PLASMA CATALYZER

(76) Inventor: Hristo A. Batchvarov, No. 73, fl.2 ap. 5, Sofia (BG)

( * ) Notice: Subject to any disclaimer, the term of this patent is extended or adjusted under 35 U.S.C. 154(b) by 0 days.

(21) Appl. No.: 11/465,704

(22) Filed: Aug. 18, 2006

(65) Prior Publication Data

US 2008/0006253 A1 Jan. 10, 2008

(30) Foreign Application Priority Data

Jul. 7, 2006 (EP) ..... 060116767

(51) Int. Cl.
*F02P 3/04* (2006.01)

(52) U.S. Cl. ..... 123/606; 123/620; 123/651; 315/209 T

(58) Field of Classification Search ..... 123/606, 123/620, 651; 315/209 T
See application file for complete search history.

(56) References Cited

U.S. PATENT DOCUMENTS 4,922,883 A * 5/1990 Iwasaki ..... 123/620

FOREIGN PATENT DOCUMENTS

BG 64065 11/2003

* cited by examiner

*Primary Examiner*—T. M Argenbright
(74) *Attorney, Agent, or Firm*—Marshall, Gerstein & Borun LLP

(57) ABSTRACT

The catalyzer is applicable in the ignition of gasoline engines of transportation vehicles, generates, stand alone and stationary machines and others. Its advantage is that it has a higher quality of the ignition and an increased efficiency. The first version of the electronic high frequency plasma catalyzer by standard ignition with a mechanical distributor consists of a constant current power supply—battery (1) and a standard ignition system of the petrol engine, which contains a microprocessor (2) with a built in it electronic switch (K). To the information input of the microprocessor there is joined up a sensor (D) for obtaining of a start and synchronizing signal, received from the mechanical distributor. The output of the electronic switch (K) is connected to the one end of a high voltage ignition coil (3), joined up with the plus pole of the battery via a key (4).

3 Claims, 4 Drawing Sheets

ELECTRONIC HIGH FREQUENCY PLASMA CATALYZER

REFERENCE OF RELATED APPLICATIONS

This application claims priority to European Patent Application EP06116767, filed Jul. 7, 2007.

FIELD OF THE INVENTION

The invention relates to an electronic high voltage plasma catalyzer applicable in the injection of petrol engines of transportation vehicles, generators, stand alone and stationary machines etc.

PRIOR ART

It is well known that an electronic high voltage plasma catalyzer consists of a constant current supplying source—battery and the ignition system of the petrol engine which contains a standard high voltage ignition coil connected to the battery via a switch. The ignition coil is joined up to an integrating constant current rectifier, connected to a primary transistor which controls a second and a third end TMOS transistor and they are coupled with a capacitance-resistance feed back. They are switched to a high frequency transformer where the high voltage from the ignition coil is fed through a disconnecting diode to the high voltage mechanical distributor of the sparking plugs of the gasoline engine. The high voltage of the high frequency transformer is supplied for detection to the high voltage diode which is connected to the high voltage mechanical distributor of the sparking plugs of the gasoline engine. The low voltage supply of the high voltage transformer is switched directly to the battery (BG 64065).

The disadvantage of the famous electronic high frequency catalyzer is that it does not have good enough quality of the ignition and sufficient efficiency.

The object of the invention is to create an electronic high frequency catalyzer of a higher quality of the ignition and an increased efficiency.

TECHNICAL DESCRIPTION OF THE INVENTION

This object is achieved by providing a first embodiment of an electronic high frequency plasma catalyzer which uses the standard ignition by a mechanical distributor and consists of a constant current supply—a battery and a standard ignition system of a gasoline engine, which contains a microprocessor with an electronic switch K integrated in it. To the information input of the microprocessor there is connected a sensor for receipt of a start signal and a synchronizing signal which is delivered by a flywheel of a crankshaft of the engine or from a shaft of a mechanical distributor. An outlet of the electronic switch K is connected to the one end of a high voltage ignition coil, coupled via a switch to a plus pole of the battery. A secondary high voltage winding of the high voltage ignition coil is coupled via a dividing diode to a pin of the high voltage mechanical distributor and to a plurality of sparking plugs of the gasoline engine, where to this pin there is connected a secondary high voltage winding through a rectifier diode group. Its first winding is joined up to the anode of one lead of a TMOS transistor whose cathode is bound with a minus pole of the battery. Both windings of the high frequency transformer are connected through their secondary leads directly to the plus pole of the battery. Adjacent to these leads, between their joint point and the minus pole of the battery, there is switched a first blocking high frequency capacitor. In the circuit there is an integrating generator whose supply is joined up through the switch to the plus pole of the battery, as well as there are a primary and a secondary transistors whose emitters are connected to the minus pole of the battery. A collector of the primary transistor is connected to the plus pole of the battery via a first resistor and the switch. The joint point between the output of the microprocessor and the primary winding of the high voltage ignition coil is connected to the base of the primary transistor through a limiting filter. The collector of the primary transistor is switched to the input of the integrating generator too, whose output is connected to the base of the secondary transistor via a voltage separator. Its collector is joined up to the base of the third transistor. The base and the collector of the secondary transistor are put together with the plus pole of the battery via a resistor. The emitter of the third transistor is joined up to the minus pole of the battery through a corresponding resistor and through another resistor—to the gate of the TMOS transistor whose anode is secured via a stabilizing Z-diode to the minus pole of the battery. The output of the generator of right-angled impulses is connected to the collector of the third transistor and the second blocking high frequency capacitor is put between the common supply connection after the switch and the minus pole of the battery.

A second embodiment of the electronic high frequency plasma catalyzer is also provided, which differs from the first one in that the pin is connected via the distributing diode to the secondary winding of the high voltage ignition coil and the high voltage winding of the high frequency transformer is coupled to the joint point of the active electrode of every sparking plug and the terminal of the high voltage mechanical distributor, corresponding to each sparking plug.

Another embodiment is also provided of an electronic high frequency plasma catalyzer for standard electronic ignition with an "I" number of high voltages switch to the plus pole of the battery and with its initial lead through corresponding to them distributing diodes—to the input of the limiting filter, where an "I" number of control outputs of the microprocessor are connected correspondingly to the control inputs of an "I" number of electronic commutators of the standard electronic ignition whose supply inputs are coupled through the contact switch with the plus pole of the battery. Their control outlets are joined up to the primary lead of the corresponding to them primary windings of the high voltage ignition coils and their secondary windings are connected to their primary leads through their corresponding diodes with the output of the rectifier diode group and their secondary leads—with the active electrode of their corresponding sparking plugs.

An advantage of the electronic high frequency catalyzer in its three embodiments is that it has a higher quality of the ignition and increased efficiency.

DESCRIPTION OF THE ENCLOSED FIGURES

The invention is described in more detail by means of an example of carrying out the electronic high frequency catalyzer shown in the accompanying figures wherein.

EXAMPLE OF CARRYING OUT THE INVENTION

Figure 1:
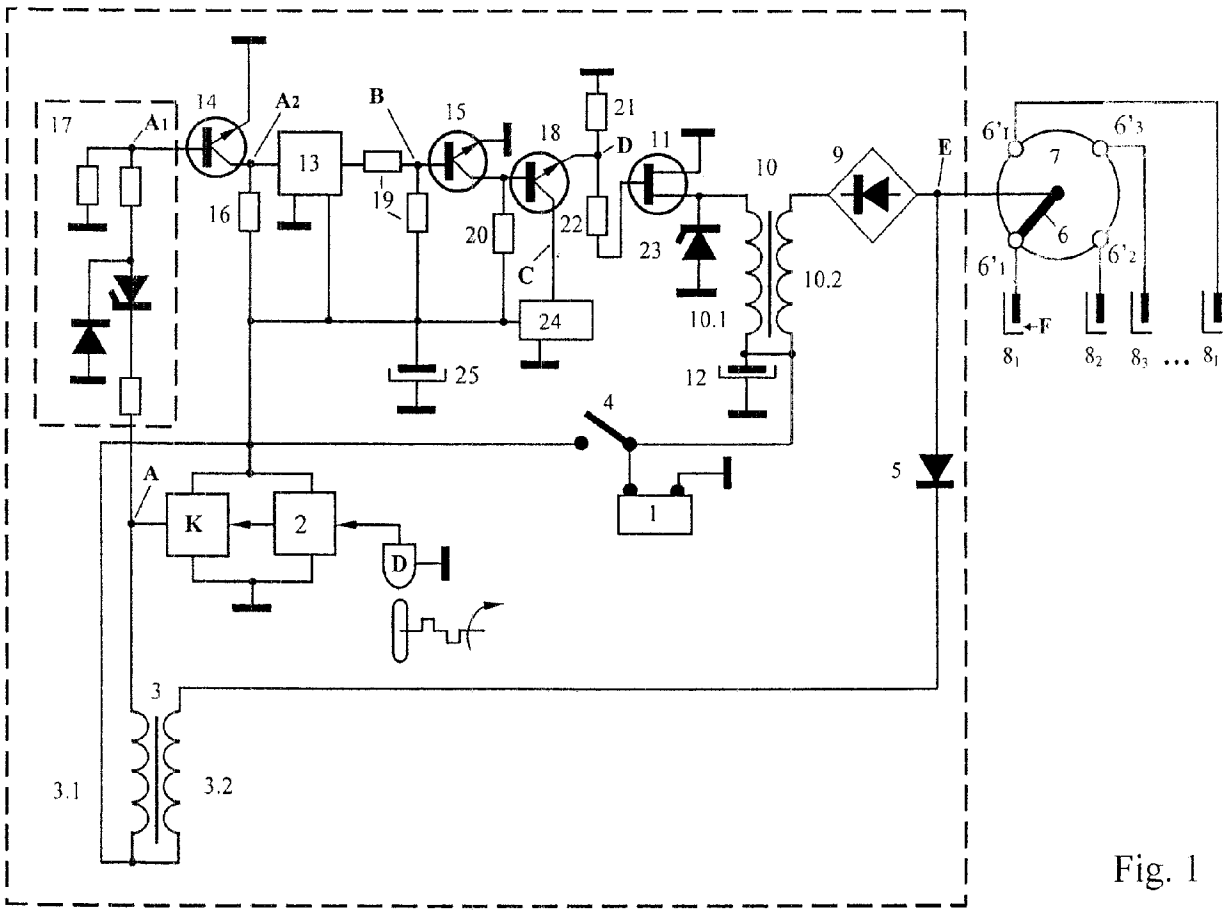
FIG. 1 is a first embodiment of the principle electrical connection of an electronic high frequency plasma catalyzer to a standard ignition with a mechanical distributor.

The first embodiment of the electronic high frequency catalyzer from FIG. 1 which, in case of a standard ignition with a mechanical supplier, consists of a constant current power supply—battery 1 and a standard ignition system of the gasoline engine which contains a microprocessor 2 with a built in it electronic switch K. To the data input of the microprocessor 2 there is connected a sensor D to receive a start signal and a synchronizing signal coming from a flywheel of a crankshaft of the engine or from a shaft of a mechanical distributor. An output of the electronic switch (K) is connected to the one lead of a high voltage ignition coil 3 and is coupled through switch 4 with a plus pole of the battery 1. A secondary high voltage winding 3.2 of the high voltage ignition coil 3 through a dividing diode 5 is connected to a pin 6 of a high voltage mechanical distributor 7 with a plurality of sparking plugs $\mathbf{8}_1$ to $\mathbf{8}_I$ of the gasoline engine and to pin 6 through a rectifier diode group 9 there is coupled a secondary high voltage winding 10.2 of a high frequency transformer 10 whose cathode is joined up to the minus pole of the battery 1.

Both windings of the high frequency transformer 10 are connected with their secondary leads directly to the plus pole of the battery 1. Adjacent to these leads, between their joint point and the minus pole of the battery 1, there is coupled the first blocking high frequency capacitor 12. In the circuit there is an integrating generator 13 whose power supply is joined up through the switch 4 to the plus pole of the battery 1 and there are primary 14 and secondary 15 transistors too whose emitters are coupled with the minus pole of the battery 1. A collector of the primary transistor 14 through the first resistor 16 and the switch 4 is connected to the plus pole of the battery 1. The joint point between the output of the microprocessor 2 and the primary winding 3.1 of the high voltage ignition coil 3 is coupled with the base of the primary transistor 14 through the limiting filter 17. The collector of the primary transistor 14 is joined up to the input of the integrating generator 13 too, whose output is connected through the voltage separator 19 with the base of the secondary transistor 15 whose collector leads to the base of the third transistor 18. The base and the collector of the secondary transistor 15 are coupled with the plus pole of the battery 1 via resistor 20. The emitter of the third transistor 18 through its corresponding resistor 21 is connected to the minus pole of the battery 1 and through another resistor 22—with the gate of the TMOS transistor 11 whose anode leads through the stabilizing Z-diode 23 to the minus pole of the battery 1. The output of the generator for right-angled impulses 24 is joined up with the collector of the third transistor 18 and the second blocking high frequency capacitor 25 is coupled between the joint supply connection after the switch 4 and the minus pole of the battery 1.

Figure 2:
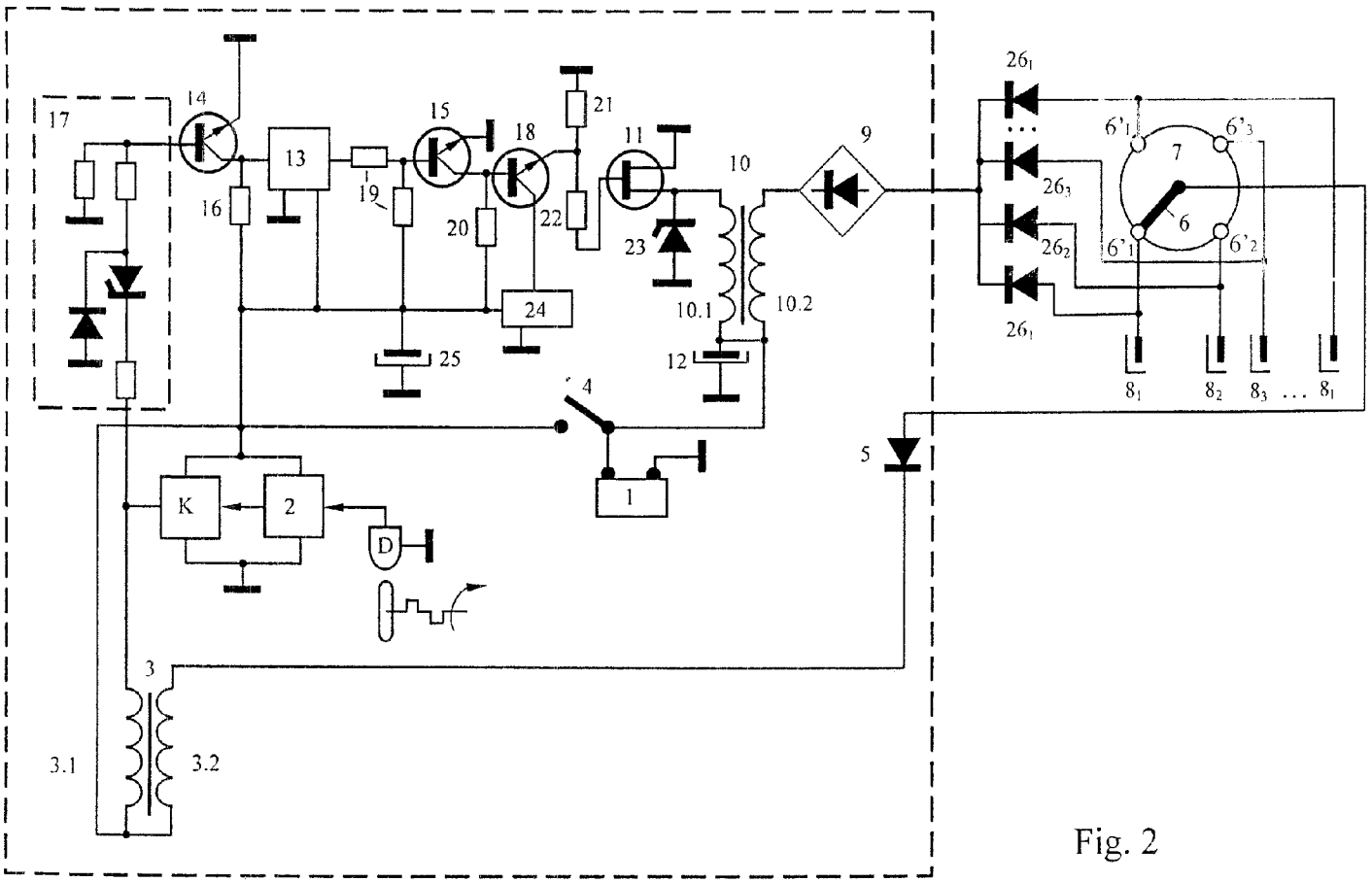
FIG. 2 is a second embodiment of a principle circuit of an electronic high frequency plasma catalyzer to a standard ignition with a mechanical distributor.

The second embodiment of the electronic high frequency plasma catalyzer on FIG. 2 differs from the first one in that the pin 6 is connected through the separation diode 5 with the second winding 3.2 of the high voltage ignition coil 3 and the high voltage winding 10.2 of the high frequency transformer 10 via the rectifier diode group 9 and via the corresponding separation diodes $\mathbf{26}_1$ to $\mathbf{26}_I$ it is connected with the mutual point of the active electrode of every sparking plug $\mathbf{8}_1$ to $\mathbf{8}_I$ and the terminal corresponding to each sparking plug of the high voltage mechanical distributor 6.

In the third embodiment of the electronic high frequency plasma catalyzer for standard electronic ignition 27 (FIG. 3) with an "I" number of high voltage ignition coils $\mathbf{3}_1$ to $\mathbf{3}_I$, each of their primary windings $\mathbf{3.1}_1$ to $\mathbf{3.1}_I$ is wired with its secondary lead through the switch 4 with the plus pole of the battery 1 and with its primary lead through their corresponding separation diodes $\mathbf{28}_1$ to $\mathbf{28}_I$—with the input of the limiting filter 17. In this case an "I" number of control outputs of the microprocessor 2 are correspondingly wired with the control inputs of an "I" number of electronic commutators $\mathbf{29}_1$ to $\mathbf{29}_I$ from the standard electronic ignition 27, whose supply inputs are joined through the contact switch 4 with the plus pole of the battery 1 and their control outputs are connected with the initial lead of the corresponding primary windings $\mathbf{3.1}_1$ to $\mathbf{3.1}_I$ of the high voltage ignition coils $\mathbf{3}_1$ to $\mathbf{3}_I$ whose secondary windings $\mathbf{3.2}_1$ to $\mathbf{3.2}_I$ are put together with their primary leads through their corresponding diodes $\mathbf{30}_1$ to $\mathbf{30}_I$ with the output of the rectifier diode group 9 and with their secondary leads—with the active electrode of their belonging sparking plugs $\mathbf{8}_1$ to $\mathbf{8}_I$.

FUNCTIONING OF THE INVENTION

Figure 4:
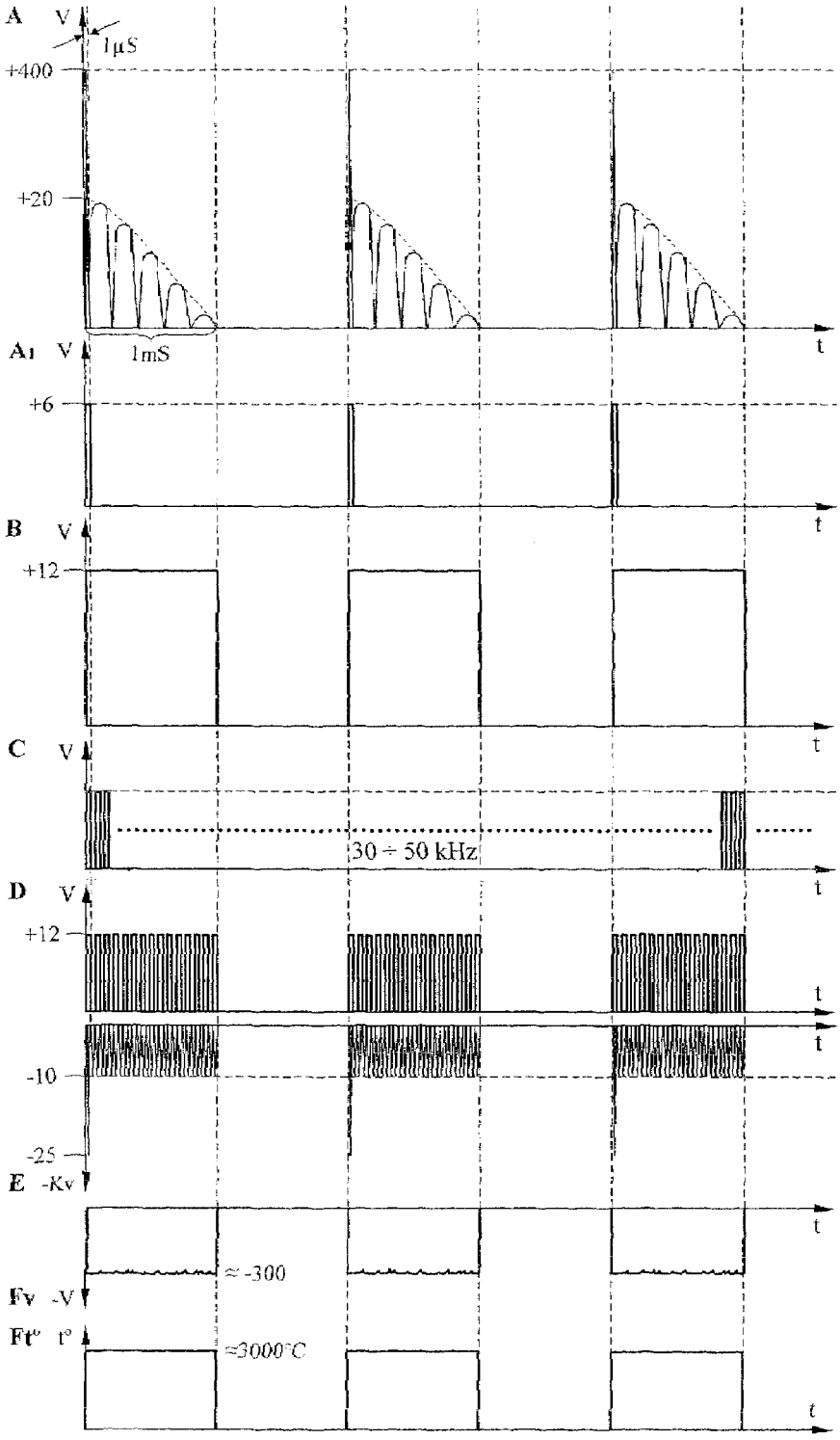
FIG. 4 is a group of time charts illustrating the functioning of the electronic high frequency plasma catalyzer of FIG. 1.

The electronic high frequency plasma catalyzer which is connected with the mechanical distributor, functions in the following way:

When starting of the engine by turning on of the contact switch 4 and putting of the supply of the circuit from battery 1 on 12-14V when the flywheel of the crankshaft starts moving, the sensor D which follows it in order to obtain a start and synchronizing signal (for example a magnetic, or a hall, or an optical or any other suitable kind), generates a start impulse for the microprocessor 2. This microprocessor 2, based on the information from sensor D for receiving of a start and synchronizing signal for transitory revolutions of the engine, controls the electronic switch K on whose output A one obtains a series of short peak impulses from +200 to +400V (FIG. 4—diagram A). The first of these impulses is the start impulse. The series of these impulses is filtered and limited from the limiting filter 17 into a right-angled form with an amplitude of +0.6V and duration of 1 to 3 μs (FIG. 4 diagram $A_1$). By the initial starting these limited in their amplitude impulses are amplified by the primary transistor 14 up to amplitude of +12V. The working times for servicing of every sparking plug $t_{ri}$ depend on the revolutions of the engine and on the number of cylinders which is a constant figure for a given type of engine. When increasing the number of the revolutions the duration of the times $t_{ri}$ decreases and these impulses get compressed. These series of impulses actuates the integrating generator 13 on whose output one gets a series of right-angled impulses with an amplitude of +0.6V and a constant duration of 1 ms (FIG. 4—diagram B). At the same time from the starting point the generator of right-angled impulses 24 creates a continuous series of right-angled impulses with a constant frequency of 30 to 50 kHz and a constant amplitude of +12V (FIG. 4—diagram C). This series of impulses is transferred to the emitter repeater—transistor 18, on whose base there is applied (via the amplifier—transistor 15) a series of right-angled impulses which are of a higher amplitude up to +12V and a constant duration of 1 ms. Due to the mixing of the two signals in the emitter repeater—transistor 18—on its output one obtains a series of impulse groups with identical duration of 1 ms, which is modulated with right-angled impulses with a frequency of 30 to 50 kHz (FIG. 4—diagram D). This series of impulse groups which is 1:1 synchronous with the revolutions of the engine, is amplified from the TMOS transistor 11 and is put to the primary winding 10.1 of the high frequency transformer 10. One creates on its secondary high voltage winding 10.2 a series of impulse groups with an identical duration of 1 ms with a high voltage and an impulse frequency in the groups from 30 to 50 kHz which is independent from the turnover of the engine. This signal is rectified by the diode group 9 with a value of −7 up to −10 kV and together with the signal from the high voltage winding 3.2 of the ignition coil 3 with a voltage of about −25 kV and an impulse duration of about 1 ms it is delivered trough the distributing diode 5 to the pin 6 of the high voltage distributor 7 (FIG. 4—diagram E). The distributing diode 5 prevents from loss of power because it does not allow the plasma voltage to fall down through the secondary winding 3.2 of the high voltage ignition coil 3. When the pin gives this signal to the ignition electrode of the corresponding sparking plug 8, its resulting load with an amplitude of about −25 kV causes a spark in the sparking plug which decreases the breakthrough voltage in the space between the electrodes up to −500 V. At the same time the gasoline ignites in the fuel chamber which corresponds to this sparking plug 8. In the created plasma channel the second high frequency series consists of a series of fading impulses with an amplitude of about −10 kV at the beginning which goes down to about −500 V. These impulses keep the plasma signal active for 1 ms, i.e. the spark which secures the extension of the process of the active fuel ignition and it burns down almost 100% in the time which is foreseen for the working process of the engine.

In the embodiment on FIG. 2 the electronic high frequency plasma catalyzer has the same working mode but the high voltage plasma voltage at the output of the diode rectifier 9 is transferred directly through the distribution high voltage diodes $\mathbf{26}_1$ to $\mathbf{26}_I$ to the sparking electrodes of their corresponding sparking plugs $\mathbf{8}_1$-$\mathbf{8}_I$. In this way one eliminates the electrical losses of power caused by the resistance of the plasma channel in the working air gap, which is generated every time the pin 6 passes by the corresponding electrodes $\mathbf{6'}_1$-$\mathbf{6'}_I$ for leading of the ignition voltage to the ignition electrodes of the corresponding sparking plugs $\mathbf{8}_1$-$\mathbf{8}_I$. At the same time the wearing out of the pin 6 and the electrodes $\mathbf{6'}_1$-$\mathbf{6'}_I$ is decreased because they are no longer under the influence of the generated plasma channels between the pin 6 and these electrodes.

Figure 3:
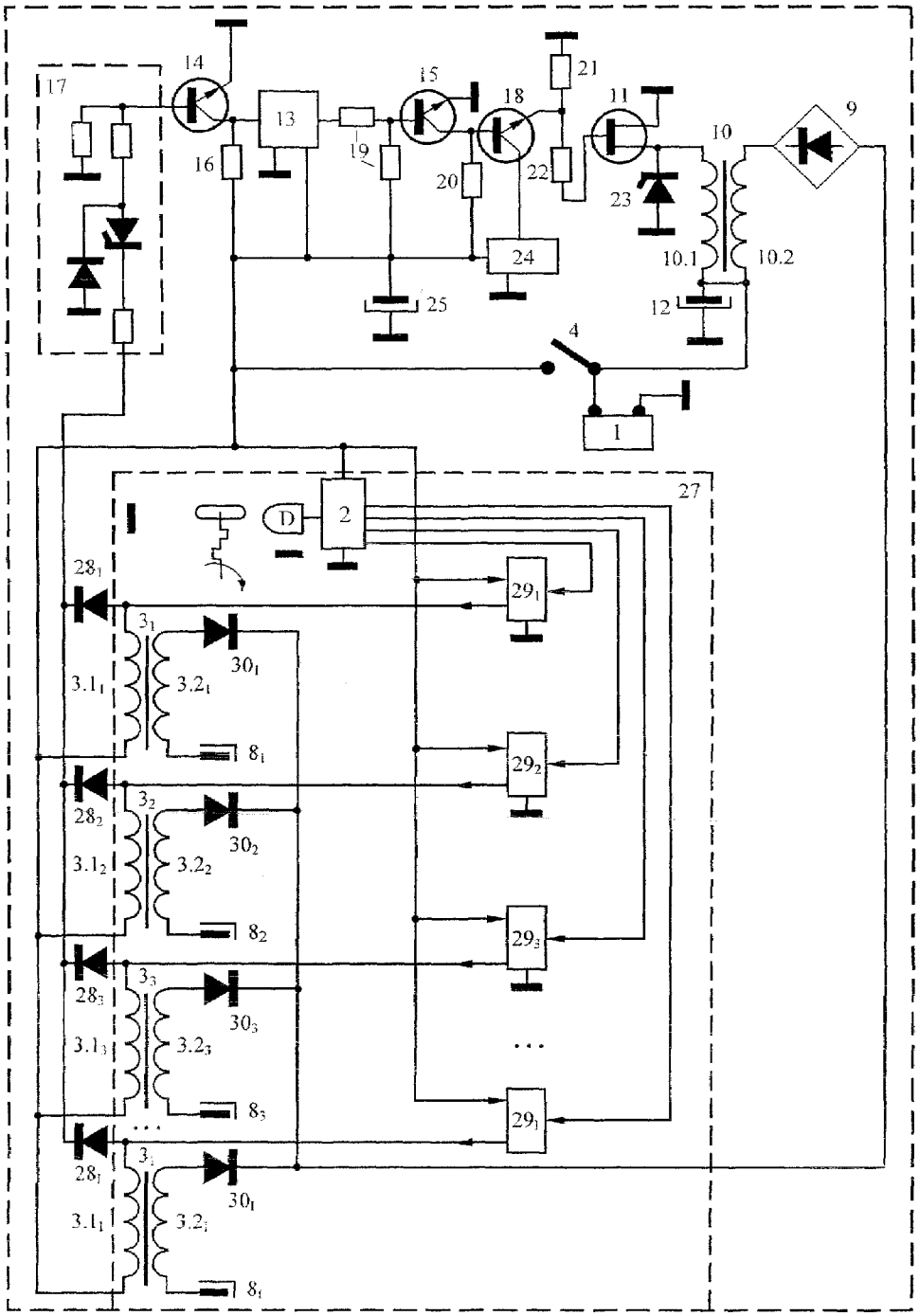
FIG. 3 is a principle circuit of an electronic high frequency plasma catalyzer to a standard electronic ignition.

In the embodiment on FIG. 3 the electronic high frequency plasma catalyzer for standard electronic ignition 27 has the same working mode as described above but when turning on of the switch 4 any of the coils $\mathbf{3}_I$ starts the circuit in the above-described manner. The presence of the diodes $\mathbf{28}_1$-$\mathbf{28}_I$ allows the corresponding impulses of the primary windings $\mathbf{3.1}_1$ to $\mathbf{3.1}_I$ to reach point A only when a control signal is given from the microprocessor 2 to their corresponding electronic commutators $\mathbf{29}_1$ to $\mathbf{29}_I$. In this way the functioning of the circuit is synchronized. The diodes $\mathbf{30}_1$ to $\mathbf{30}_I$ react in the same way like the diodes $\mathbf{26}_1$ to $\mathbf{26}_I$ on FIG. 2 but at the same time they execute the function of the distributing diode 5 for the high voltage coils belonging to them. One obtains in this way the ignition order of the sparking plugs 8.

The electronic high frequency plasma catalyzer reads in all versions continuously the physical parameters and the processes typical for the moment of ignition. This happens due to the dependence of the amplitude of the ignition impulses from:

- the temperature of the engine at the moment of ignition: When it is warm, the ionization takes place more easily and due to this the breaking through voltage between the electrodes of the sparking plugs goes down, i.e. the amplitude of the high frequency impulses which support the plasma channel, goes down too;
- the degree of wearing out of the engine: When the engine is well preserved and has a high compression (with a high ohm resistance between the electrodes of the sparking plugs), the breakthrough voltage between them can increase more than twice. Vice versa, when the engine is worn out, respectively by low compression, the breakthrough voltage can decrease more than twice;
- the condition of the sparking plugs: When the electrodes of the sparking plugs are worn out, the distance between them increases and the ohm resistance between them increases respectively and due to this the breakthrough voltage between them increases.
- The revolutions of the engine and/or the number of cylinders: The effectiveness of the ignition described here, differing from all well known till now types of ignitions (using only one ignition impulse from 1 μs) does not depend on the revolutions and/or on the number of cylinders because the high frequency ignition impulses always keep active at least for 1 ms the plasma channel (the spark). This means that the duration of the active fuel ignition is 1000 times longer than in any of the well known types of ignition. As an illustration there are shown the sparks generated for ignition of the test stand by a switched off and a switched on electronic high frequency plasma catalyzer at different revolutions of the engine. The experimental data showed that the power of the plasma channel by switched on electronic high frequency plasma catalyzer increases much more rapidly than when the catalyzer is switched-off.

In this way the electronic high frequency plasma catalyzer increases the efficiency of the ignition because it provides for the full burning out of the fuel. At the same time, due to the fact that the fuel burns out completely, its consumption decreases. Due to the same reason, there is no emission of unused fuel into the atmosphere which decreases the environmental pollution to a large extent.

The application of the electronic high frequency plasma catalyzer is applicable for following types of fuel: gaseous—all kinds; liquefied—all types of gasoline and methanol. Due to the fact that the electronic high frequency plasma catalyzer brings to the full burn out of the combustion mixture, the standard chemical catalyzer in some of the cars gets surplus.

The electronic high frequency plasma catalyzer does almost not wear out because the electronic components in it function in a comfortable mode. Practically the life of this ignition is about 100 000 working hours. Independently from the fact that the duration of the active ignition is prolonged by 100 times and between the electrodes of the sparking plugs there develops a higher temperature than in case of not using the electronic plasma catalyzer, this does not change the guaranteed life of the sparking plugs because they have the chance to cool down to the norm during alternation.

The electronic high frequency plasma catalyzer is compact and light. It covers all standards for electronic systems and can be easily mounted in the space around the engine of the car.

I claim:

1. An electronic high frequency plasma catalyzer which, in case of a standard ignition with a mechanical distributor, comprises one constant current power supply—battery (1) and a standard ignition system of a gasoline engine, which contains a microprocessor (2) with an integrated electronic switch (K), where to the information input of the microprocessor (2) there is connected a sensor (D) for receiving a start signal and a synchronizing signal, obtained from a flywheel of a crankshaft of the engine or from a shaft of a mechanical distributor and an output of the electronic switch (K) is connected with the one lead of a high voltage ignition coil (3) and with a plus pole of the battery via a switch (4), where a secondary high voltage winding (3.2) of the high voltage ignition coil (3) via the distribution diode (5) is fitted together with a pin (6) of a high voltage mechanical distributor (7) and with a plurality of sparking plugs ($\mathbf{8}_1$) to ($\mathbf{8}_I$) of the gasoline engine and to the pin (6) through a rectifier diode group (9) there is connected a secondary high voltage winding (10.2) of a high frequency transformer (1) whose primary winding (10.1) is fitted together with an anode of an end TMOS transistor (11), whose cathode is joined up to a minus pole of the battery (1) and the two windings of the high frequency transformer (10) are connected to their secondary leads directly to the plus pole of the battery (1), where very close to these leads between their common point and the minus pole of the battery (1) there is connected a first blocking capacitor (12), where there is an integrating generator (13) whose power supply is joined up through the switch (4) with the plus pole of the battery (1) and there is a primary (14) and a secondary (15) transistor, whose emitters are coupled with the minus pole of the battery (1), where a collector of the first transistor (14) through a primary resistor (16) and the switch (4) is connected to the plus pole of the battery (1), wherein a common point between the output of the microprocessor (2) and the primary winding (3.1) of the high voltage ignition coil (3) is fitted together with the base of the primary transistor (14) via the limiting filter (17) and the collector of the primary transistor (14) is connected with the input of the integrating generator (13), whose output is joined up through a voltage distributor (19) with the base of a third transistor (18) and the base and the collector of the secondary transistor (15) are coupled with the plus pole of the battery (1) via a resistor (20), the emitter of the third transistor (18) through its corresponding resistor (21) is connected with the minus pole of the battery (1) and via another resistor (22) to the gate of the TMOS transistor (11), whose anode is fitted with a stabilizing Z-diode (23) to the minus pole of the battery (1), where the output of a generator of right-angled impulses (24) is joined up with the collector of the third transistor (18), a second blocking high frequency capacitor (25) is fitted together between the power lead after switch (4) and the minus pole of the battery (1).

2. An electronic high frequency plasma catalyzer according to claim 1 wherein the pin (6) is connected through the distributing diode (5) with the secondary winding (3.2) of the high voltage ignition coil (3) and the high voltage winding (10.2) of the high frequency transformer (1) through the rectifier diode group (9) and via corresponding distribution diodes ($\mathbf{26}_1$) to ($\mathbf{26}_I$) it is connected with the common point of the active electrode of each of the plurality of sparking plugs ($\mathbf{8}_1$) to ($\mathbf{8}_I$) and with the corresponding terminals of the high voltage mechanical distributor (6).

3. An electronic high frequency plasma catalyzer according to claim 1 adapted for a standard electronic ignition (27) with an "I" number of high voltage ignition coils ($\mathbf{3}_1$) to ($\mathbf{3}_I$), where each of their primary windings ($\mathbf{3.1}_1$) to ($\mathbf{3.1}_I$) is connected with its second lead through the switch (4) with the plus pole of the battery (1) and with its first lead through their corresponding distribution diodes ($\mathbf{28}_1$) to ($\mathbf{28}_I$)—with the input of the limiting filter (17), where an "I" number of control outputs of the microprocessor (2) are connected with the control inputs of an "I" number of electronic commutators ($\mathbf{29}_1$) to ($\mathbf{29}_I$) of the standard electronic ignition (27) whose feeder-inputs are fitted together through the switch (4) with the plus pole of the battery (1), their control outputs are connected to the first end of their corresponding initial windings ($\mathbf{3.1}_1$) to ($\mathbf{3.1}_I$) of the high voltage ignition coils ($\mathbf{3}_1$) to ($\mathbf{3}_I$), whose secondary windings ($\mathbf{3.2}_1$) to ($\mathbf{3.2}_I$) are connected with their first leads through their corresponding diodes ($\mathbf{30}_1$) to ($\mathbf{30}_I$) with the output of the rectifier diode group (9) and with their second leads—with the active electrode of their corresponding sparking plugs ($\mathbf{8}_1$) to ($\mathbf{8}_I$).

* * * * *

UNITED STATES PATENT AND TRADEMARK OFFICE

CERTIFICATE OF CORRECTION

PATENT NO. : 7,341,051 B2
APPLICATION NO. : 11/465704
DATED : March 11, 2008
INVENTOR(S) : Hristo A. Batchvarov It is certified that error appears in the above-identified patent and that said Letters Patent is hereby corrected as shown below:

Title page;

On the Cover Sheet, item (76) should read:

(76) Inventor: Hristo A. Batchvarov, Cherkovna Str. No. 73, fl.2 ap. 5, Sofia (BG)

Signed and Sealed this

Twenty-third Day of November, 2010

David J. Kappos

David J. Kappos
*Director of the United States Patent and Trademark Office*